United States Patent [19]

Blackhurst

[11] Patent Number: 5,044,696

[45] Date of Patent: Sep. 3, 1991

[54] CURB CUTTING SYSTEM AND METHOD

[76] Inventor: Michael Blackhurst, 27 Squires Avenue, East York, Ontario, Canada, M4B 2R2

[21] Appl. No.: 541,657

[22] Filed: Jun. 21, 1990

[51] Int. Cl.[5] ..... E01C 23/09

[52] U.S. Cl. ..... 299/41; 83/928; 125/14

[58] Field of Search ..... 299/39, 41, 15, 73; 404/90, 83; 125/13.03, 14; 30/379.5; 83/487, 488, 928

[56] References Cited

U.S. PATENT DOCUMENTS

| | | | |
|---|---|---|---|
| 1,565,444 | 12/1925 | Hashim | 299/39 |
| 3,649,071 | 3/1972 | Graff | 299/41 |
| 3,785,705 | 1/1974 | Binger et al. | 30/379 X |
| 4,357,120 | 11/1982 | MacDonald | 404/83 |
| 4,433,871 | 2/1984 | Bertrand | 299/41 |
| 4,792,190 | 12/1988 | Bertrand | 299/41 |
| 4,832,412 | 5/1989 | Bertrand | 125/14 X |
| 4,930,386 | 6/1990 | Lashowski et al. | 83/928 X |

*Primary Examiner*—Ramon S. Britts
*Assistant Examiner*—David J. Bagnell
*Attorney, Agent, or Firm*—Caesar, Rivise, Bernstein, Cohen, & Pokotilow, Ltd.

[57] ABSTRACT

A fully powered, one man curb cutter is mounted as part of a special purpose trailer, for towing behind a vehicle to its location of use. A motorized and steerable fifth wheel is deployed downwardly from a retracted to an extended position, to raise the trailer tongue clear of the hitch, and is used to propel and steer the trailer into a desired position adjacent a curb to be sawed. A pair of nearside jacks may be deployed adjacent the curb to be sawn, in supporting relation with the saw, the trailer wheels being partially retracted in order to stabilize the system. Sequential adjustments to the trailer jacks and wheels permit setting the power driven saw to a desired angle, with the wheels then being fully retracted. The saw is driven directly from a motor carried inboard, which also powers the saw feed longitudinally along a track mounted on the chassis frame of the trailer. The motor powers a hydraulic pump which also drives the fifth wheel system as well as serving to power the jacks, the retraction of the main wheels, and the vertical positioning and lateral feed of the saw.

23 Claims, 7 Drawing Sheets

CURB CUTTING SYSTEM AND METHOD

TECHNICAL FIELD

This invention is direct to a curb cutting system and in particular to a trailer mounted circular saw with a fully powered system, and its method of use.

BACKGROUND ART

The provision of curb cutting equipment, with diamond faced saws for cutting cement curbs has assumed considerable important.

Concrete curb cutters are known, such as those illustrated in: U.S. Pat. Nos. 3,649,071, Graff; 3,785,705, Binger; 4,357,120, MacDonald; 4,433,871, Bertrand; 4,792,190, Bertrand; 4,832,412, Bertrand;

These prior art systems are labor intensive, usually requiring at least a 2 person crew in order to set up and operate the machines.

In view of the relative slowness at which extensive cuts can be made, the multi-person requirement increases costs by a considerable amount.

In the case of Bertrand, the system operates on the basis of a truck, having cumbersome side beams that are swing outboard, to carry the track by which the cutting carriage is suspended. The system is expensive, in that it involves a specialty vehicle, dedicated to the system.

In the case of MacDonald, the hand actuated jacks and partial reliance on the support provided by the trailer running gear diminish the stability and reliability of the system, while increasing set-up times.

TECHNICAL FIELD

In the following description the side of the vehicle from which a curb is cut is called the "nearside", the vehicle other side being the "offside".

The present invention provides a vehicle for cutting curbs, having an elongated chasssis frame; fixed track means extending along the frame having a carriage movably mounted thereon for displacement along the track means; a curb cutting saw adjustably mounted on the carriage for use in cutting a curb located adjacent the carriage; first jacking means selectively deployable to the nearside of the chassis frame, to support the nearside thereof and the saw; second jacking means located adjacent the off-side of the vehicle to support the offside of the chassis frame; and retractable wheel means to enable selective lowering of the vehicle onto the jacks, in supported relation thereon.

The vehicle includes drive means for propelling the vehicle.

In the preferred embodiment the drive means comprises a fifth wheel located at the front thereof adjacent a trailer hitch, the wheel being selectively movable for raising the hitch clear of a towing vehicle, to enable working engagement of the powered fifth wheel with the ground, for manoeuvering and steering the vehicle, and to permit retraction of the fifth wheel, for unrestricted lowering of the vehicle chassis.

The vehicle motor is mounted upon the carriage, in direct coupled relation with the saw transmission which comprises a clutch, an axially extensible drive shaft connecting with a bevel gearbox located on the nearside of the carriage and having a downwardly extendable output shaft connecting with the circular saw blade. The gearbox is mounted upon a support tube, having a hydraulic jack in controlling relations therewith, for projection of the saw towards the curb side.

The gearbox is secured to the laterally extending support tube by way of an adjustable flange, permitting manual adjustment of the downward inclination of the output shaft, by pivotal rotation of the gearbox about the polar axis of the input shaft, to cant the saw at a selected angle from the vertical.

A hydraulic pump connected in driven relation with the motor provides hydraulic power to the four vehicle services. The first of these comprises the fifth wheel having a double acting jacking cylinder and piston to extend and retract the fifth wheel up or down, and a hydraulic rotary motor coupled in driving relation with the fifth wheel, by way of a sprocket and chain drive.

The second hydraulic service comprises the vehicle jacking system, including: deployment jacks for swinging the near-side jacking arms in or out, and extension jacks for lengthening or shortening the near-side jacking arms; and the two offside jacks, which are preferably permanently secured to the chassis frame at respective fore and aft locations.

The third hydraulic service comprises the retraction and extension jacks for the main wheels, by which the vehicle is lowered onto its supporting jacks or raised into a road worthy condition.

The fourth hydraulic service is the carriage drive, which comprises a rotary hydraulic motor, preferably of the vane type, driving a toothed cog by way of sprocket and toothed belt. The toothed cog engages the toothed surface of a gear track extending for a major portion of the length of the chassis frame, to displace the carriage along the length of the vehicle.

With the hydraulic controls strategically grouped, the vehicle can be located and the system set up in a curb cutting mode in rapid fashion, by a single individual with a minimum of physical effort.

Operation of the vehicle and curb cutting system comprises the steps of:

positioning the vehicle both laterally and longitudinally in desired relation with a curb to be cut;

deploying a first set of jacks to the nearside of the vehicle, at a selected height setting;

partially retracting the vehicle wheels to settle the first jacks in ground engaging relation;

adjusting the first set of jacks and the extent of wheel retraction to provide a desired orientation of the saw carriage;

deploying a second set of jacks on the offside of the vehicle into ground engaging, stable supporting relation with the offside of the vehicle, to maintain the desired saw carriage orientation; and, retracting the vehicle wheels out of ground contact, with the vehicle in supported relation upon its jacks.

Initial handling and positioning of the vehicle consists of deployment of the vehicle fifth wheel in nose raising relation, to clear the trailer hitch, and engaging and steering the fifth wheel to manoeuvre the vehicle into a desired operating position.

The respective jacking operations, including deployment and extension of the nearside jack outrigger arms, are obtained by remote controls, located adjacent the fifth wheel.

Inclination of the saw for laterally inclined cut, such as a curb flank is effected manually by pivotal angular adjustment to the bevel gear drive box.

Upon completion of the setting up of the vehicle, preparatory to making a cut, the respective positioning jack systems are hydraulically isolated into a locked condition, to immobilize the vehicle.

The saw carriage, is mounted by four grooved wheels located at the carriage corners upon a pair of guide rails, and held by four hold-downs that secure it to the rails during transportation.

On the completion of vehicle set-up, the carriage hold-downs are released and the carriage located longitudinally on the vehicle by way of the cog drive, at the precise location of the starting cut.

Engagement of the saw clutch couples the motor with the saw transmission, causing it to rotate at cutting speed. The height of the saw blade is obtained by vertical sawjack actuation, and a mechanical lock to set the height of the saw.

Actuation of the saw advance jack extends the lateral drive shaft, moving the saw laterally outwardly from the vehicle into curb cutting engagement, to establish the depth of the cut. Upon achieving the desired cut depth, and with the advance jacks hydraulically locked the cog drive is pressurized to an extent necessary to achieve the desired rate of travel of the carriage, as the cut proceeds.

BRIEF DESCRIPTION OF DRAWINGS

Certain embodiments of the invention are described by way of illustration thereof, and without limitation of the invention thereto, reference being made to the accompanying drawings, wherein.

Figure 1:
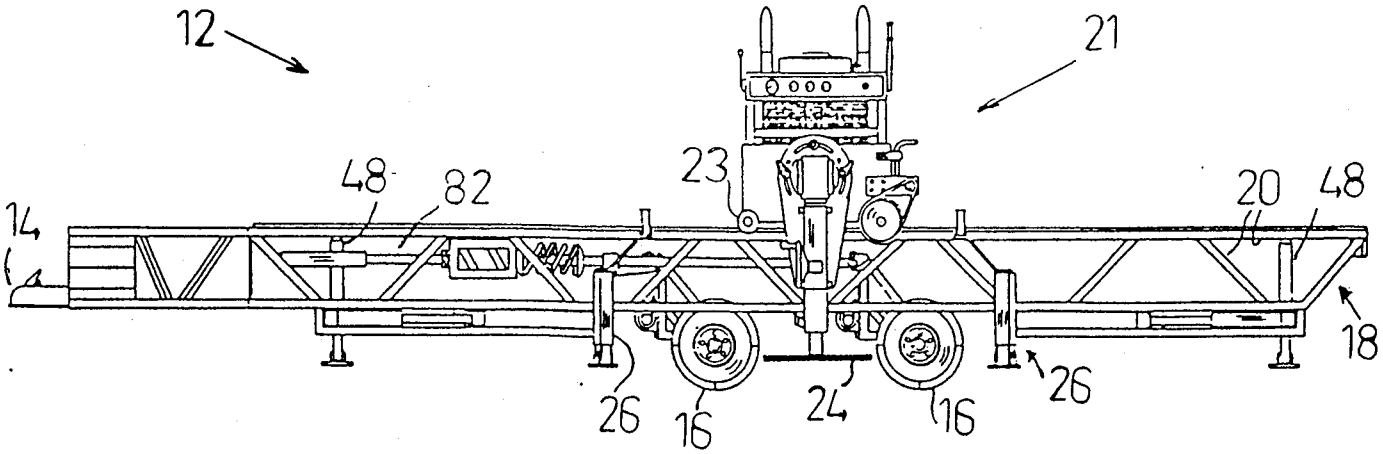
FIG. 1 is a side elevation of a first embodiment of a curb-cutting vehicle according to the present invention without the means for self-propulsion.

It will be observed that different scales have been used in various view, for purposes of convenience.

BEST MODE OF CARRYING OUT THE INVENTION:

Referring to FIGS. 1–7, the curb cutting vehicle 12 is basically of trailer form, having a nose hitch 13 and a 4-wheels 16 close coupled in tandem.

A deep section space frame 18 constructed in the main of square section tubing 20 provides a vehicle of enormous stiffness, and relatively light weight, upon which saw carriage 21 is mounted, by way of grooved wheels 23 located at the four corners thereof.

The term "near-side 22" and off-side 23' as used herein relate to the curb at which the vehicle functions, being the reverse of the normal use of those terms for a left hand drive vehicle.

The near-side 22 of the vehicle 12, over which the saw 24 is suspended, has a pair of near-side hydraulic jacks 26 equipped with handles 28 for manual fine adjustment thereto.

The jacks 26 are removably inserted in telescopic deployment arms 30. The arms 30 are each pivoted at 32, having a double acting hydraulic jack 34 to pivot the arms 30, and rectangular guide frame 36 extending longitudinally beneath the near-side 22 of space frame 18 in which to slide. An extension jack 38 pivoted at 40, 42 enables extension of the telescopic arms 30 to almost double their length, in cantilevered supporting relation with the near-side jacks 26 for any selected angular position in the range A, shown in FIG. 5.

A pair of double acting vehicle hydraulic jacks 48 at the off-side 23' extend vertically from adjacent the front and rear ends of the vehicle 12.

Figure 6:
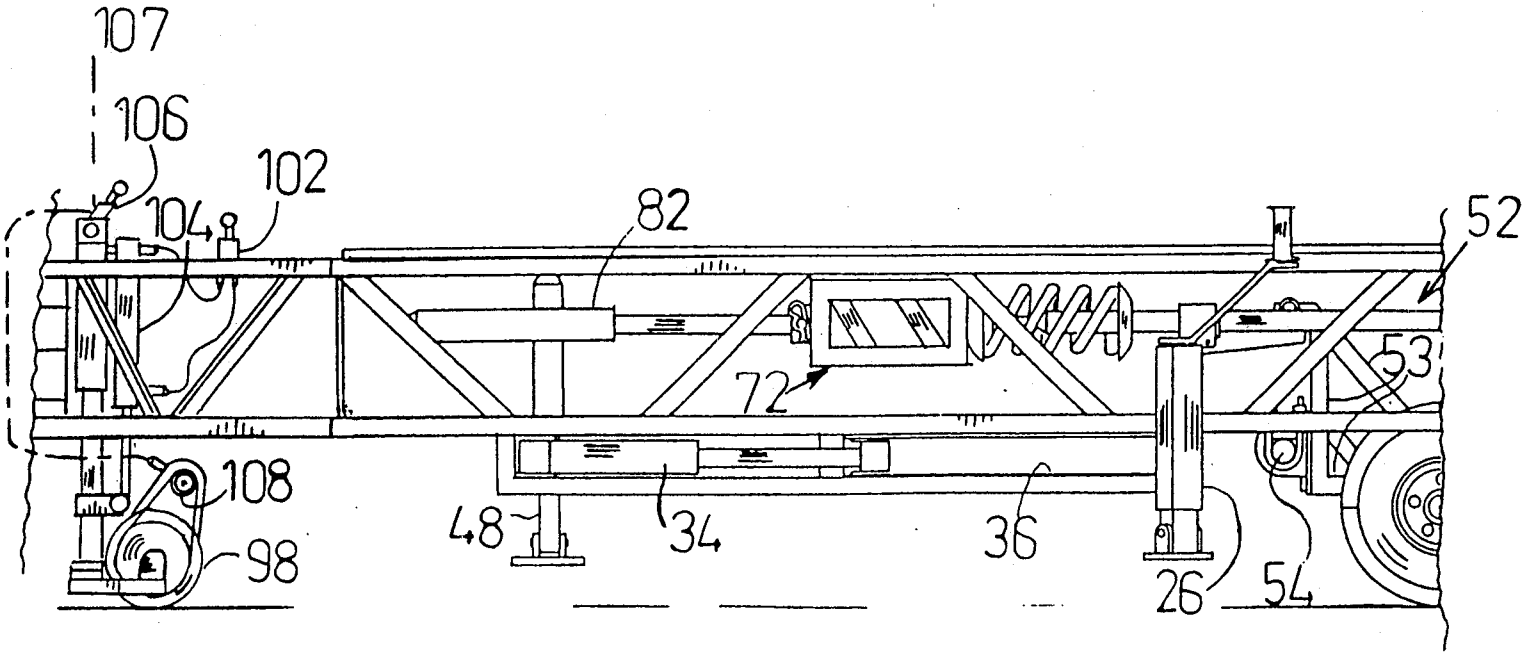
FIG. 6 is a side elevation of the FIG. 4 portion of the vehicle.
Figure 7:
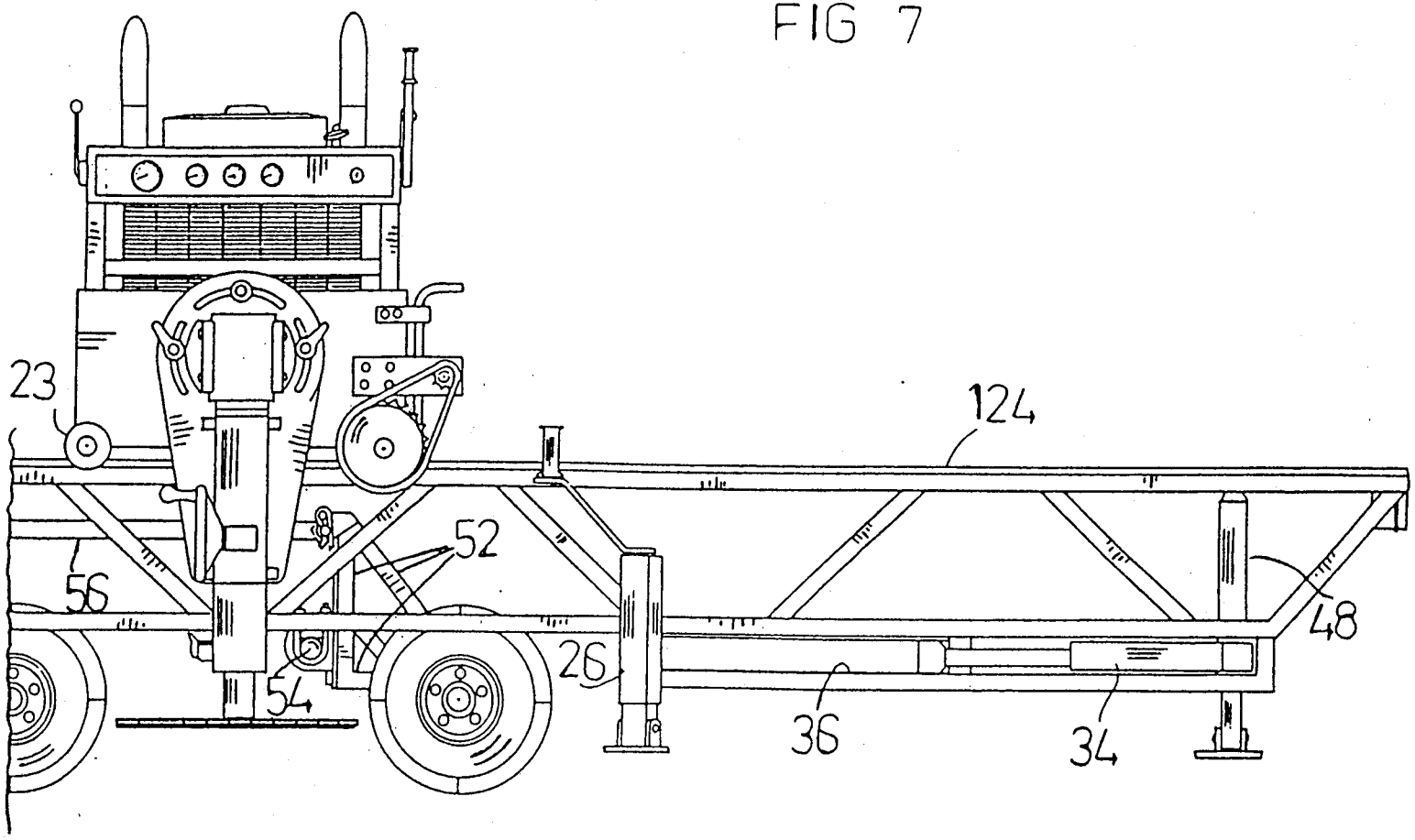
FIG. 7 is a side elevation of the FIG. 5 portion of the vehicle.

The wheels 16 are carried on axles 50, the axles 50 being supported by triangulated frame 52 having members 53, pivoted at 54 to the space frame 18 (See FIGS. 1 and 6).

Push-pull rods 56 are pivotally connected at 58 (FIG. 5) with the rear triangulated frame 52, for fore and aft displacement, to pivot rear axle 50 and the rear wheels 16 up and down, as required.

Push-pull rods 60 (FIG. 4) pivotally connected at 62 with the front triangulated frame 52 for fore and aft displacement, serve to pivot the front axle 50 and the front wheels 16 up and down as required.

Figure 4:
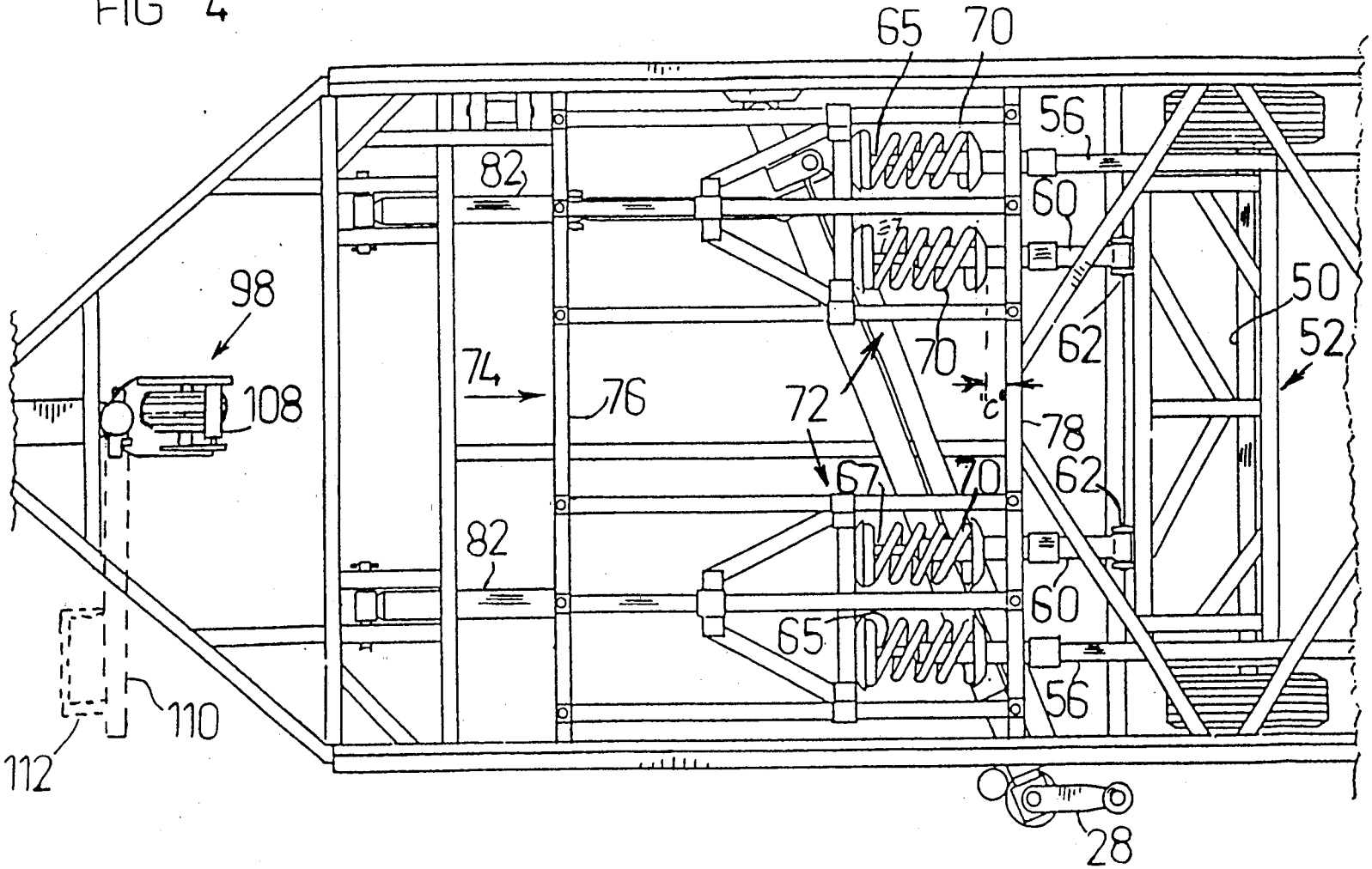
FIG. 4 is a plan view of a front portion of the vehicle, having a fifth wheel propulsion unit thereon.
Figure 5:
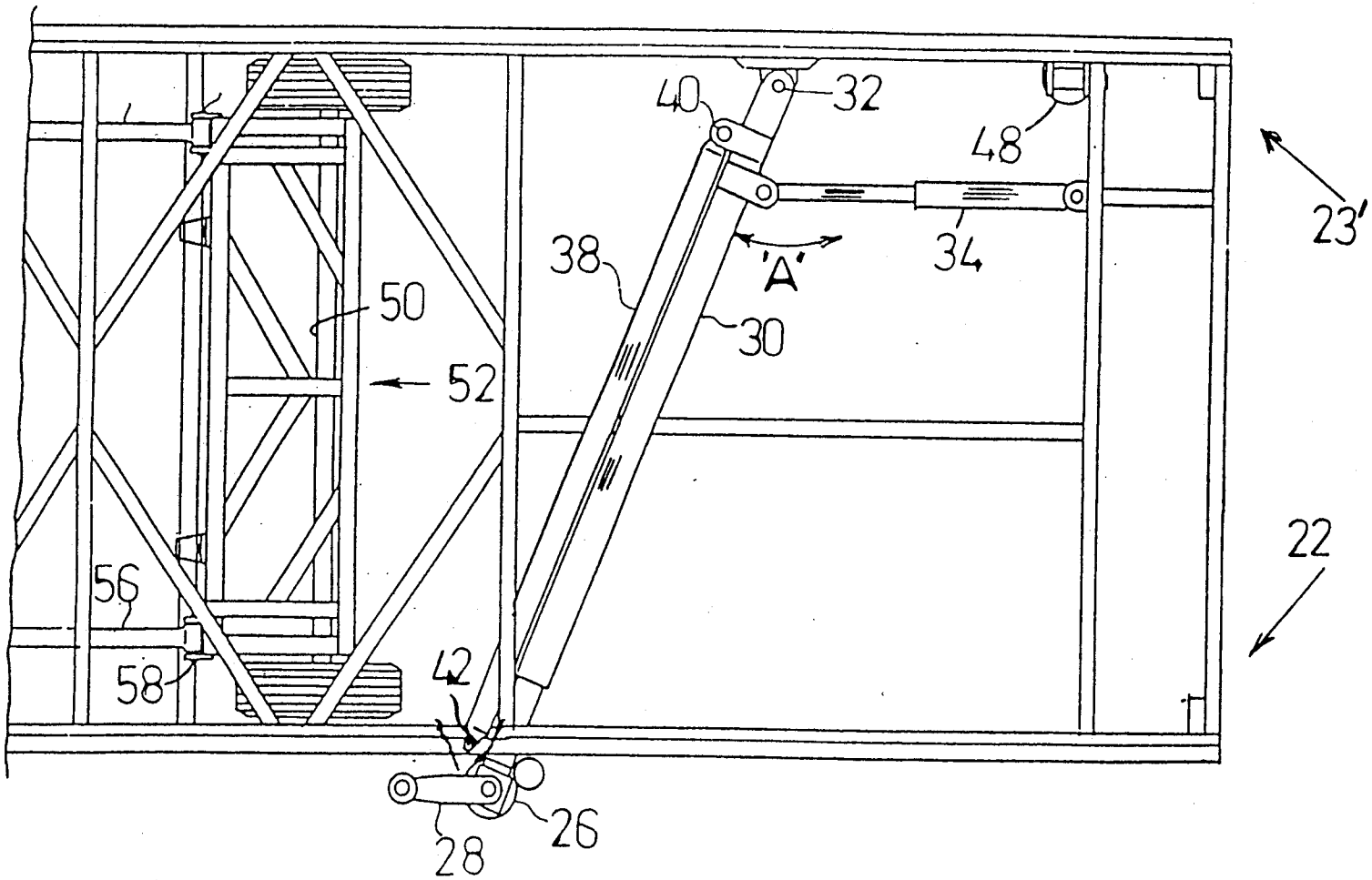
FIG. 5, is a plan view of a rear portion of the vehicle.

Referring to FIG. 4 the respective forward ends 65, 67 of push-pull rods 56 and 60 are spring loaded by suspension springs 70 into the partly extended position shown, the compression clearance 'C' illustrated, from the encompassing respective four sided load frames 72 (see FIG. 6).

Figure 2:
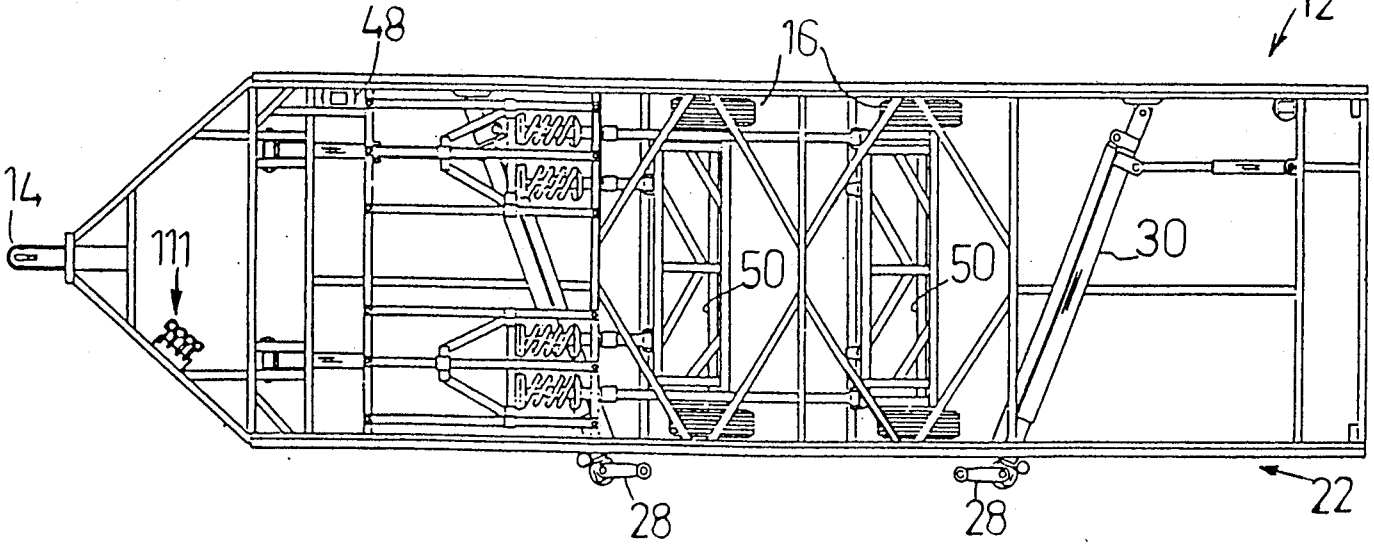
FIG. 2 is a plan view of the chassis frame and running gear of FIG. 1, without the saw carriage.
Figure 3:
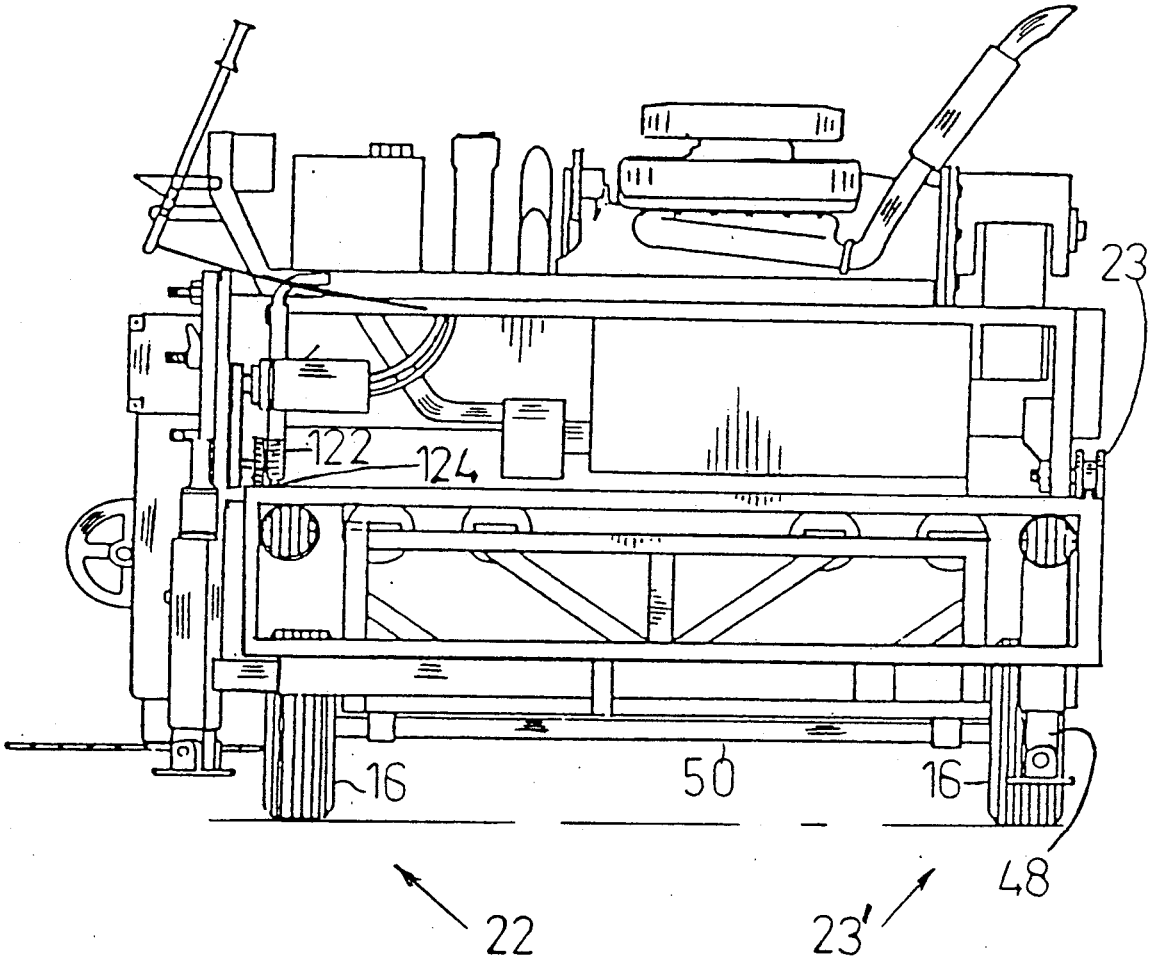
FIG. 3 is a rear end elevation of the FIG. 1 embodiment.

Referring to FIGS. 2 and 4, a suspension synchronizing frame 74, having transverse members 76, 78, and longitudinal load members 72 is slidably mounted on the space frame 18, having a pair of double acting hydraulic height control jacks 82 secured thereto. Actuation of the height control jacks 82 control the longitudinal position of the synchronizing frame 74 on the chassis frame 18, thereby raising or lowering the wheels 16 accordingly.

Figure 8:
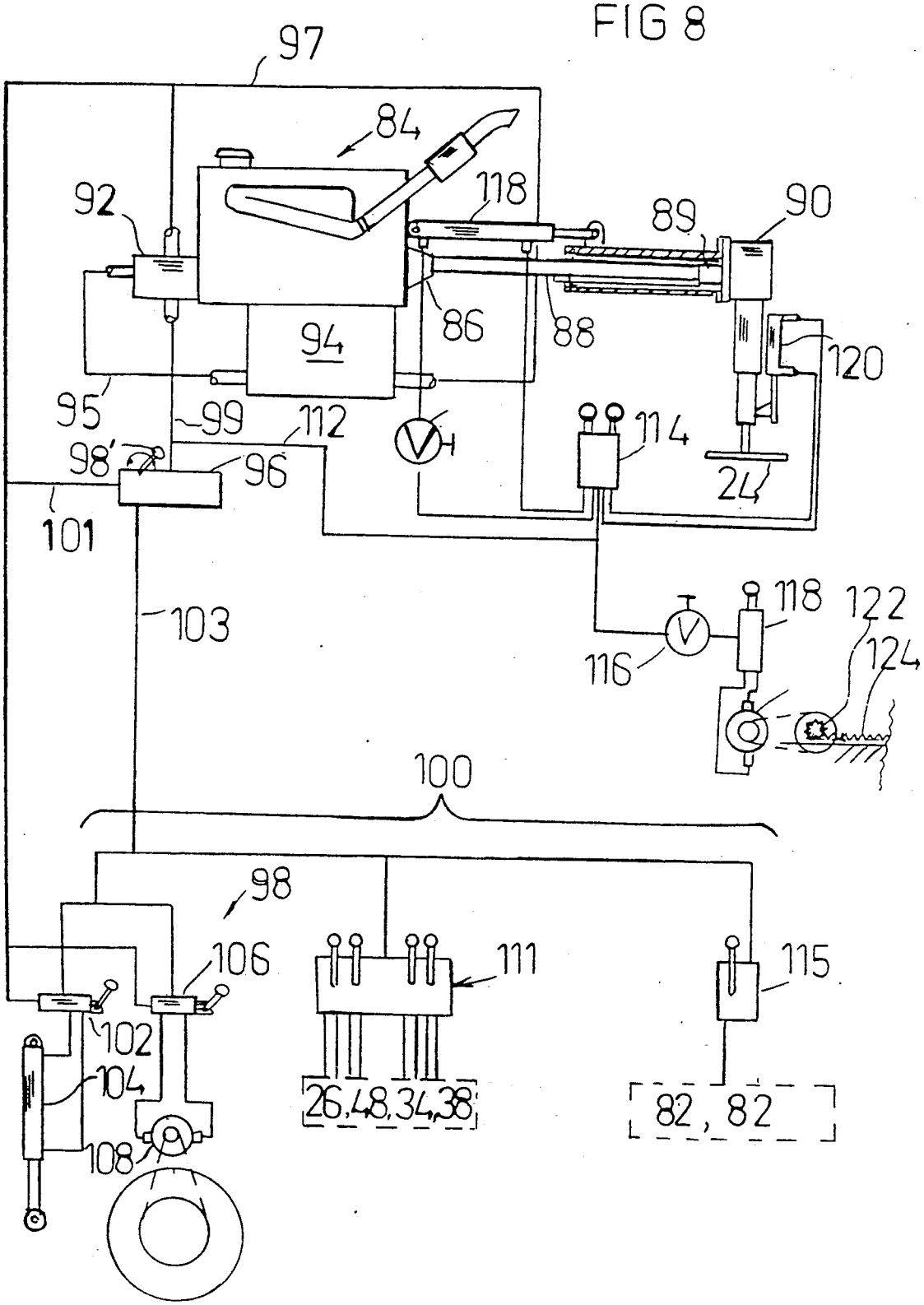
FIG. 8 is a schematic diagram including the hydraulic circuits.

Referring to FIG. 8, the motor 84, illustrated as being an internal combustion engine connects by way of clutch 86 with keyed drive shaft 88 telescopically connected through a quill shaft 89 with bevel gear box 90.

The motor 84 also drives hydraulic pump 92, which is fed from oil reservoir 94 by way of line 95. The pump relief valve (not shown) connects with oil return line 97. Pump output line 99 connects with control isolation valve 96 having recirculation control 98 by which the input is diverted by way of bypass line 101 to the reservoir 94.

The output of valve 96 goes by line 103 to serve the vehicle movement and jacking system 100 comprising the vehicle fifth wheel propulsion unit 98; the vehicle jacking units 26, 48 and associated deployment jacks 34, 38; and the main wheel raising and lowering control jacks 82.

The isolation valve 96 serves to isolate and immobilize the vehicle displacement and jacking system 100, once set-up of the vehicle in an operating mode is accomplished.

The movement and jacking system 100 includes control valve 102 for the jacking actuator 104, which raises and lowers the fifth wheel 98; and control valve 106 for rotating or locking the rotary hydraulic motor 108 by which the wheel 98 is driven.

The fifth wheel 98 is steered by a removable tiller bar 110, shown in phantom in FIG. 4, by which the wheel 98 is force castered about the polar axis 107 (see FIG. 6). The tiller bar 110 includes a torque bracket 112 by which bar 110 may be twisted, to produce actuation of valve 106 for forward, reverse or locked operation of motor 108.

A gang of control valves 111 control the respective jacks to deploy and operate jacks 26, 48 and the rearside arms deployment actuators 34, 38.

Pump output line 99 connects with line 112, which is constantly pressurized while the pump 92 is in operation.

The line 112 connects with control valve 114 for controlling the push-pull lateral and vertical actuators 118, 120 of the saw 24. Also, by way of variable pressure control valve 116 (see FIG. 8) the line 112 connects with control valve 118 by which the carriage positioning motor 120' is controlled. The rotary motor 120' connects by way of a toothed belt and reduction gears with cog wheel 122, in toothed engagement with gear track 124. The track 124 (FIGS. 3 and 7) extends longitudinally for substantially the full length of the space frame 18, whereby a full range of travel for the saw carriage 21 is obtained.

The control valve 114 connects by pressure reduction valve 126 with the lateral actuator 118 by which the outward, lateral feed rate of the saw 24 may be set.

In operation, the vehicle 12 may be towed by a truck or light vehicle to the working site.

While on tow the fifth wheel 98 is fully retracted and locked. On arrival, the motor 84 is started, thus energizing the hydraulic pump 92. The isolation valve 96 is set to the upon position, to serve the movement and jacking system 100.

Control valve 102 is first actuated, with hitch 14 in a released condition, to lower the fifth wheel 98, and thus raise hitch 14 clear of the towing vehicle. Insertion of the tiller bar 110 and twisting thereof about its polar axis by way of torque bracket 112, in the appropriate direction, actuates the valve 106 and motor 108, to drive the fifth wheel and the vehicle 12 in the desired direction. Manipulation of tiller bar 110 serves to steer the vehicle 12 as required.

Upon achieving the desired location of vehicle 12 the tiller bar 110 is released, whereupon the valve 106 goes to the neutral position, effectively locking the motor 108 against rotation, so as to brake the vehicle. The wheels 16 also may be temporarily chocked, at which time the fifth wheel 98 may be retracted.

The respective control valves of the control gang 111 are actuated to deploy the near-side jacks 26 upon their arms 30, in coordinated operation with control valve 115, by which the actuator jacks 82, 82 cause the wheels 16 to raise and lower, for the near-side jacks 26 to engage the ground.

The off-side jacks 48 also are operated, with the space frame 18 at the desired height and orientation, to secure the space frame 18 in supported relation thereon. The wheels 16 are then fully raised out of ground contact, and the divertor valve control 98' moved to the bypass position, whereby the system 100 is effectively locked in place and hydraulically isolated.

The carriage positioning valve 118 may now be actuated to position the carriage 21 at a desired longitudinal location upon the space frame 18.

The saw 24 is positioned at the desired height by actuation of control valve 114.

The clutch 86 may then be actuated, bringing motor 84 into driving relation with the saw 24. Operation of actuator 118, by way of control valve 114 feeds the saw 24 laterally into cutting relation with the curb. When the desired lateral penetration of saw 24 into the curb is achieved, operation of valve 118 propels carriage 21 and the saw 24 at a desired cutting rate along the curb.

INDUSTRIAL APPLICABILITY

Curb cutting machines are widely used for cutting vehicle entry ways, wheel chair ramps and the like through existing concrete or stone curbs, for which work the presently disclosed machine is eminently suited, particularly in view of its one-person operating capability.

I claim:

1. A vehicle for cutting curbs, having an elongated chassis frame; fixed track means extending along the frame, having a carriage movably mounted thereof for displacement along the track means; a curb cutting saw adjustably mounted on the nearside of the carriage for use in cutting curbs located adjacent the carriage; first jacking means selectively deployable to the nearside of the chassis frame, to support the near-side of the chassis frame and said saw; second jacking means located adjacent the off-side of the vehicle, to support the off-side thereof; retractable wheel means to enable selective lowering of said vehicle onto said first and second jacking means, in supported relation thereon, and drive means for propelling said vehicle.

2. The vehicle as set forth in claim 1, said drive means being retractably mounted on said vehicle, to permit unrestricted lowering of said chassis frame.

3. The vehicle as set forth in claim 1, having motor means mounted on said carriage, in direct driving relation with said saw, including clutch and transmission means therefor.

4. The vehicle as set forth in claim 3, said transmission means including a laterally extensible first drive shaft extending from said carriage, to permit extension of said saw laterally from said vehicle towards said curb.

5. The vehicle as set forth in claim 4, including actuator means in selectively controllable lateral displacing relation of said saw.

6. The vehicle as set forth in claim 4, said transmission means including a gear box connected with said drive shaft in driven relation thereby, having a downwardly extending second drive shaft connected in driving relation with said saw.

7. The vehicle as set forth in claim 6, said gear box being pivotally mounted for angular rotation thereof about the axis of said first drive shaft, to permit the pivoting of said saw at a selected angle from the vertical.

8. The vehicle as set forth in claim 6, said downwardly extending second drive shaft being extensible, to adjust the downward location of said saw; and jack means connected in selective controlling relation therewith.

9. The vehicle as set forth in claim 1, said carriage having motor means thereon connected in direct driving relation with said saw.

10. The vehicle as set forth in claim 1, said carriage having motor means thereon; hydraulic pump means driven by said motor means; said drive means having a hydraulic motor connected with said pump means, and attached in driving relation with at least one retractable road wheel, to propel said vehicle.

11. The vehicle as set forth in claim 10, wherein said retractable road wheel is a fifth wheel located adjacent one end of the vehicle.

12. The vehicle as set forth in claim 11, said retractable road wheel having hydraulic jack means in height controlling relation therewith, connected to said pump means.

13. The vehicle as set forth in claim 1, said retractable wheel means including hydraulic actuator means for raising and lowering said retractable wheel means in selective supporting relation with the vehicle.

14. The vehicle as set forth in claim 13, said retractable wheel means comprising a first pair of wheels, and a second pair of wheels in tandem relation with said first pair.

15. The vehicle as set forth in claim 14, said retractable wheel means including including first synchronizing frame means carrying said first pair of wheels pivotally secured to said chassis frame for upward retraction and downward deployment of said first pair of wheels.

16. The vehicle as set forth in claim 15, said retractable wheel means including second synchronizing frame means carrying said second pair of wheels pivotally secured to said chassis frame for upward retraction and downward deployment of said second pair of wheels.

17. The vehicle as set forth in claim 16, having suspension actuating means connected in positioning relation with said first and said second synchronizing frame means.

18. The vehicle as set forth in claim 17, said retractable wheel means including spring means, to secure said wheels in resilient, load bearing relation with said vehicle.

19. The vehicle as set forth in claim 17, said retractable wheel means including a pair of hydraulic actuators positioned substantially horizontally in said vehicle, to effect substantially synchrozized deployment and retraction of said wheels.

20. In a curb cutting system having a wheeled vehicle with a carriage mounted thereon for planar movement longitudinally of the vehicle, and having a motor driven saw extending laterally from the carriage adjacent the vehicle, the method of operating the vehicle comprising the steps:

(1) deploying a driven fifth wheel in steered driving relation with the vehicle, to position the vehicle laterally and longitudinally in desired relation with said curb;

(2) deploying a first set of jacks on the near-side of the vehicle, at a selected setting;

(3) partially retracting the vehicle wheels to settle the first jack set, in ground engaging relation;

(4) adjusting the height setting of said vehicle wheels to orient the plane of said carriage to a desired lateral orientation;

(5) deploying a second set of jacks on the off-side of the vehicle into ground engaging, stable supporting relation with the off-side side of the vehicle, to maintain said carriage orientation; and, (6) retracting the vehicle wheels out of ground contact, whereby the vehicle is fully and stably supported on said first and second jack sets.

21. The method as set forth in claim 20 wherein said first set of jacks are deployed remotely, by operation of hydraulic actuator means.

22. The method as set forth in claim 20 wherein the second, third, fourth, fifth and sixth said steps are effected by remote operation of hydraulic actuator means.

23. The method as set forth in claim 22 whereby actuation of said system may be carried out by an individual working alone.

* * * * *